US010526887B2

(12) United States Patent
Blount

(10) Patent No.: US 10,526,887 B2
(45) Date of Patent: Jan. 7, 2020

(54) DEPTH/ORIENTATION DETECTION TOOL AND METHODS THEREOF

(71) Applicant: ConocoPhillips Company, Houston, TX (US)

(72) Inventor: Curtis G. Blount, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 313 days.

(21) Appl. No.: 15/251,057

(22) Filed: Aug. 30, 2016

(65) Prior Publication Data

US 2017/0002647 A1 Jan. 5, 2017

Related U.S. Application Data

(63) Continuation of application No. 13/539,641, filed on Jul. 2, 2012, and a continuation of application No. PCT/US2012/045244, filed on Jul. 2, 2012.

(Continued)

(51) Int. Cl.
*E21B 47/00* (2012.01)
*E21B 43/116* (2006.01)

(Continued)

(52) U.S. Cl.
CPC ..... *E21B 47/09* (2013.01); *E21B 43/119* (2013.01); *E21B 47/024* (2013.01); *E21B 47/04* (2013.01);

(Continued)

(58) Field of Classification Search
CPC ..... E21B 43/119; E21B 47/044; E21B 47/024
See application file for complete search history.

(56) References Cited

U.S. PATENT DOCUMENTS 2,728,554 A 12/1955 Goble
3,175,608 A 3/1965 Wilson (Continued)

FOREIGN PATENT DOCUMENTS

CN 1712668 12/2005
CN 101116010 1/2008

(Continued)

OTHER PUBLICATIONS

Sensomet Case Study—"The World's First Installation of a Casing Conveyed DTS System, Utilising Oriented TCP in a Thermal Production and Injection Well" Sensomet 2009.

(Continued)

*Primary Examiner* — Robert E Fuller
(74) *Attorney, Agent, or Firm* — Boulware & Valoir

(57) ABSTRACT

Methods and systems for depth and radial orientation detection are provided. Methods for determining the depth or radial orientation of one or more downhole components include the steps of providing a target mass and a using a detection device for detecting the depth and/or orientation of the target mass. In some cases, the target mass is initially nonradioactive and then, after installing the target mass downhole, it may be irradiated to form a relatively short-lived radioactive target mass, which may then be detected with a radiation detector. In this way, the target mass acts as a depth or radial orientation marker. Where the target mass is situated downhole in a known radial relationship to another downhole component, the radial orientation of the other downhole component may be deduced once the radial orientation of the target mass is determined. Advantages include higher accuracies and reduced health, safety, and environmental risks.

13 Claims, 3 Drawing Sheets

Related U.S. Application Data

(60) Provisional application No. 61/505,725, filed on Jul. 8, 2011, provisional application No. 61/505,739, filed on Jul. 8, 2011.

(51) Int. Cl.

| | |
|---|---|
| ***E21B 47/09*** | (2012.01) |
| ***E21B 43/119*** | (2006.01) |
| ***E21B 47/024*** | (2006.01) |
| ***E21B 47/04*** | (2012.01) |

(52) U.S. Cl.
CPC ..... *E21B 47/044* (2013.01); *E21B 47/0905* (2013.01)

(56) References Cited

U.S. PATENT DOCUMENTS

| | | | | |
|---|---|---|---|---|
| 3,180,409 | A | 4/1965 | Dewan | |
| 3,209,828 | A | 10/1965 | Lebourg | |
| 3,291,207 | A | 12/1966 | Rike | |
| 3,342,275 | A * | 9/1967 | Mellies | E21B 43/119 166/55.1 |
| 3,869,607 | A | 3/1975 | Sandier et al. | |
| 4,233,508 | A | 11/1980 | Arnold | |
| 4,428,810 | A | 1/1984 | Webb et al. | |
| 4,700,142 | A | 10/1987 | Kuckes | |
| 5,279,366 | A | 1/1994 | Scholes | |
| 5,351,755 | A | 10/1994 | Howlett | |
| 5,548,116 | A | 8/1996 | Pandelsiev | |
| 5,753,813 | A | 5/1998 | Hagiwara | |
| 6,318,463 | B1 | 11/2001 | Fehrmann et al. | |
| 6,378,607 | B1 | 4/2002 | Ryan | |
| 6,614,229 | B1 | 9/2003 | Clark | |
| 6,761,219 | B2 | 7/2004 | Snider et al. | |
| 6,843,318 | B2 | 1/2005 | Yarbro | |
| 6,847,207 | B1 | 1/2005 | Veach et al. | |
| 7,136,765 | B2 | 11/2006 | Maier et al. | |
| 7,591,307 | B2 | 9/2009 | Gibson | |
| 8,020,619 | B1 | 9/2011 | Robertson et al. | |
| 8,122,954 | B2 | 2/2012 | Estes | |
| 2002/0185275 | A1 | 12/2002 | Yang et al. | |
| 2003/0159826 | A1 | 8/2003 | Ohmer | |
| 2006/0048937 | A1 | 3/2006 | Pinto | |
| 2007/0025512 | A1 | 2/2007 | Gertsenshteyn | |
| 2007/0034373 | A1 * | 2/2007 | McDaniel | C09K 8/805 166/250.1 |
| 2007/0034374 | A1 | 2/2007 | Gerez et al. | |
| 2009/0087912 | A1 | 4/2009 | Ramos et al. | |
| 2009/0166035 | A1 | 7/2009 | Almaguer | |
| 2011/0044418 | A1 | 2/2011 | Stubbers | |
| 2012/0043459 | A1 * | 2/2012 | Hill | E21B 23/08 250/269.4 |
| 2013/0002255 | A1 | 1/2013 | Shampine | |
| 2013/0329522 | A1 | 12/2013 | Skinner et al. | |

FOREIGN PATENT DOCUMENTS

| | | |
|---|---|---|
| CN | 101737033 | 6/2010 |
| CN | 101978429 | 2/2011 |
| EP | 0 359 642 | 3/1990 |
| GB | 2 313 861 | 12/1997 |
| WO | 95/19489 | 7/1995 |
| WO | 2000/075485 | 12/2000 |
| WO | 2003/083248 | 10/2003 |
| WO | 2011/112391 | 9/2011 |

OTHER PUBLICATIONS

Stroud "An Electromagnetic Method of Orienting a Gun Perforator in Multiple Tubingless Completions" Society of Petroleum Engineers of AIME 1971 Oct. 3-6, 1971, New Orleans, Louisiana.

A. Ogunnifa E. Ene "Application of a Novel Orienting Technology Leads to Oil Gains from Short String Through Tubing Re-Perforation in the Niger Delta", Society of Petroleum Engineers (Chevron) 2005.

Gama et al., "Oriented Perforation in Dual Completion Wells: A Real Case in East Texas" SPE Production and Operations Symposium, Apr. 4-8, 2009, Oklahoma City, Oklahoma.

Meldrum and Todorov "Providing Integrity in EOR Thermal Recovery Wells" Sensomet, Oct. 28, 2008.

Khalid and Poit, "Collaboration in Extracting More Oil in Mature Dual Completion Wells", Presentation at SPE Annual Technical Conference and Exhibition, Oct. 4-7, 2009, New Orleans, Louisiana.

Allen, D. R., "Collar and Radioactive Bullet Logging For Subsidence Monitoring," Society of Petrophysicists and Well-Log Analysts, pp. 25-28 (1969) (Abstract).

Adams, G. W., and Moffat, W. D., "Full-Signature Multiple-Channel Vertilog," Society of Petroleum Engineers, pp. 379-386 (1991) (Abstract).

International Search Report and Written Opinion issued in connection with corresponding PCT Application No. PCT/US12/45232 dated Nov. 14, 2012.

International Search Report and Written Opinion issued in connection with corresponding PCT Application No. PCT/US2012/45244 dated Nov. 27, 2012.

Partial European Search Report issued in connection with corresponding EP Application No. 12810626.7 dated Nov. 18, 2015.

Partial European Search Report issued in connection with corresponding EP Application No. 12810701.8 dated Nov. 19, 2015.

Supplemental European Search Report issued in connection with corresponding EP Application No. 12810626.7 dated Apr. 5, 2016.

Supplemental European Search Report issued in connection with corresponding EP Application No. 12810701.8 dated Apr. 5, 2016.

* cited by examiner

DEPTH/ORIENTATION DETECTION TOOL AND METHODS THEREOF

CROSS-REFERENCE TO RELATED APPLICATIONS

This application is a continuation of U.S. Non-provisional application Ser. No. 13/539,641, filed Jul. 2, 2012, which claims benefit to U.S. Provisional Application Ser. No. 61/505,725, filed Jul. 8, 2011. This application also claims benefit to PCT/US12/45244, filed Jul. 2, 2012, which claims benefit to Ser. Nos. 13/539,641, 61/505,725 and U.S. provisional application Ser. No. 61/55,739, filed Jul. 8, 2011. Each of these applications is incorporated herein by reference for all purposes.

FIELD OF THE INVENTION

The present invention relates generally to methods and systems for depth and orientation detection tools. More particularly, but not by way of limitation, embodiments of the present invention include methods and systems using depth and radial orientation tools for certain downhole operations, including perforation of downhole conduits.

BACKGROUND

During various downhole operations, it is often desired to determine the radial orientation of one or more components downhole. In the exploration and production of hydrocarbons, conduits often extend considerable depths into the subsurface. These substantial subsurface distances often complicate determining the orientation of various components downhole.

One example of a downhole operation that sometimes requires determining the radial orientation of one or more downhole components is perforating downhole conduits. Perforation is the process by which holes are created in a casing or liner to achieve efficient communication between the reservoir and the wellbore. The holes thus created from the casing or liner into the reservoir formation allows oil or gas to be produced from the formation through the casing or liner to the production tubing. The most common method of perforation uses a perforating gun equipped with shaped explosive charges.

As might be imagined, it is often desired to perforate a conduit in a radial direction away from certain sensitive downhole components. For example, some wells include cables running along the length of the conduit or tubing for transmitting power, real-time data, and/or control signals to or from surface equipment and downhole devices such as transducers and control valves. To avoid damaging the cables during perforation operations, it is necessary to perforate a conduit in a radial direction substantially away from the cable. Other sensitive devices or apparatus may be installed on or in proximity to a conduit to be perforated. In such instances, it is naturally desired to avoid damaging the sensitive devices due to perforating in the direction of a cable or other sensitive device. In some instances, it is desired to perforate a conduit away from the radial direction of another adjacent conduit.

Other applications that benefit from determination of the radial orientation include, but are not limited to, certain treatment operations and logging operations. Accordingly, determining the radial orientation of one or more downhole components is advantageous in many scenarios.

Many conventional devices have been proposed to determine the radial orientation of downhole components but each of these conventional tools suffer from a variety of disadvantages.

One example of a conventional tool is the magnetic mass tool. This approach requires installation of an additional magnetic mass in the form of a cable laid next to capillary lines to provide magnetic susceptible mass sufficient to be logged by a rotating electromagnetic logging tool. The currently used electromagnetic tools and procedures are not robust and suffer from poor accuracy, which often lead to undesirably perforating sensitive external components. In addition to poor accuracy, these devices suffer from tensile loading limitations, the need to take time-consuming stationary readings, magnetic susceptible mass requirements among other limitations. These magnetic mass tools also require good centralization within the conduit since minimal changes in distance can profoundly affect readings of the tool. Poor centralization of the tool often yields false positives resulting in perforation of a conduit in an unintended orientation.

Another conventional approach is to install perforation guns on the outside of the conduit to be perforated before the conduit is installed downhole. This alternate configuration undesirably requires a larger borehole to accommodate the perforation gun. Moreover, failure of the perforation gun in this scenario is much more significant as no ready solution is available to address this failure mode.

Other conventional tools require the use of radioactive markers or injecting the cable with a radioactive fluid. The use of radioactive markers and fluids present significant health, safety, and environmental concerns. Radioactive materials pose safety and health risks, particularly on the surface before installation downhole. Such radioactive materials typically require onerous permitting, logistics, and other significant regulatory hurdles to be met. Additionally, disposal of radioactive materials presents other challenges in addition to high costs. Accordingly, using radioactive materials and fluids above surface involves many disadvantages.

Accordingly, there is a need for enhanced radial orientation detection devices and methods for detecting radial orientations of one or more components downhole and/or perforating conduits downhole that address one or more of the disadvantages of the prior art.

SUMMARY

The present invention relates generally to methods and systems for depth and orientation detection tools. More particularly, but not by way of limitation, embodiments of the present invention include methods and systems using depth and radial orientation tools for certain downhole operations, including perforation of downhole conduits.

One example of a method for perforating a conduit disposed in a subterranean formation comprises the steps of: providing a target mass that is substantially nonradioactive; wherein the conduit is characterized by a longitudinal axis parallel to the conduit and a radial axis, wherein the radial axis is parallel to a plane that is normal to the longitudinal axis; locating the target mass in proximity to the conduit wherein the target mass is situated at a radial offset angle from a sensitive apparatus, wherein the radial offset angle is an angle from about 0° to about 360°; irradiating the target mass to form a radioactive target mass; detecting a radial orientation of the radioactive target mass; determining a perforation target based on the radial orientation of the target mass and the radial offset angle so as to reduce the risk of damage to the sensitive apparatus; and perforating the conduit at the perforation target in a direction substantially away from the sensitive apparatus so as to not damage the sensitive apparatus.

One example of a method for perforating a conduit disposed in a subterranean formation comprises the steps of: providing a target mass that is substantially radioactively inert; wherein the conduit is characterized by a longitudinal axis and a radial axis; locating the target mass in proximity to the conduit wherein the target mass is situated at a radial offset angle from a sensitive apparatus, wherein the radial offset angle is an angle from about 0° to about 360°; irradiating a region around the target mass; detecting the radial location of the radioactive target mass as an area of reduced radioactive response; determining a perforation target based on the radial location of the target mass and the radial offset angle so as to reduce the risk of damage to the sensitive apparatus; and perforating the conduit at the perforation target in a direction substantially away from the sensitive apparatus so as to not damage the sensitive apparatus.

One example of a method for determining a radial orientation in a conduit comprises the steps of: providing a target mass that is substantially nonradioactive wherein the target mass is capable of becoming radioactive upon irradiation of the target mass with an ionizing radiation; wherein the conduit is characterized by a longitudinal axis and a radial axis; locating the target mass in proximity to the conduit; irradiating the target mass with a ionizing radiation to form a radioactive target mass having a half life less than about 32 days; and detecting the radial location of the radioactive target mass using a gamma ray detector.

One example of a method for measuring deformation of a subterranean formation comprises the steps of: (a) providing a plurality of target masses at a plurality of depths in the subterranean formation, wherein the target masses are substantially nonradioactive; (b) irradiating each target mass with a neutron source to form a radioactive target mass having a half life less than about 32 days; (c) detecting an initial depth of each radioactive target mass using a gamma ray detector to determine a baseline reference depth of each radioactive target mass; (d) after step (c), irradiating each target mass with a neutron source to form a radioactive target mass having a half life less than about 32 days; (e) detecting a measured depth of each radioactive target mass using a gamma ray detector to determine a subsequent location of each radioactive target mass; and (f) comparing the baseline reference depths to the subsequent locations to determine a deformation of the subterranean formation.

One example of a method for determining a depth of a target mass in a wellbore comprises the steps of: providing a target mass, wherein the target mass is substantially nonradioactive, wherein the target mass is capable of becoming radioactive upon irradiation of the target mass with a neutron source; locating the target mass at a target depth in a wellbore; irradiating the target mass with a neutron source to form a radioactive target mass having a half life less than about 32 days; and detecting the target depth of the radioactive target mass using a gamma ray detector.

One example of a method for perforating a conduit comprises the steps of: providing a target mass, wherein the target mass is substantially nonradioactive, wherein the target mass is capable of becoming radioactive upon irradiation of the target mass with a neutron source; locating the target mass at a target depth in a wellbore; irradiating the target mass with a neutron source to form a radioactive target mass having a half life less than about 32 days; detecting the target depth of the radioactive target mass using a gamma ray detector; and perforating the conduit at the target depth.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
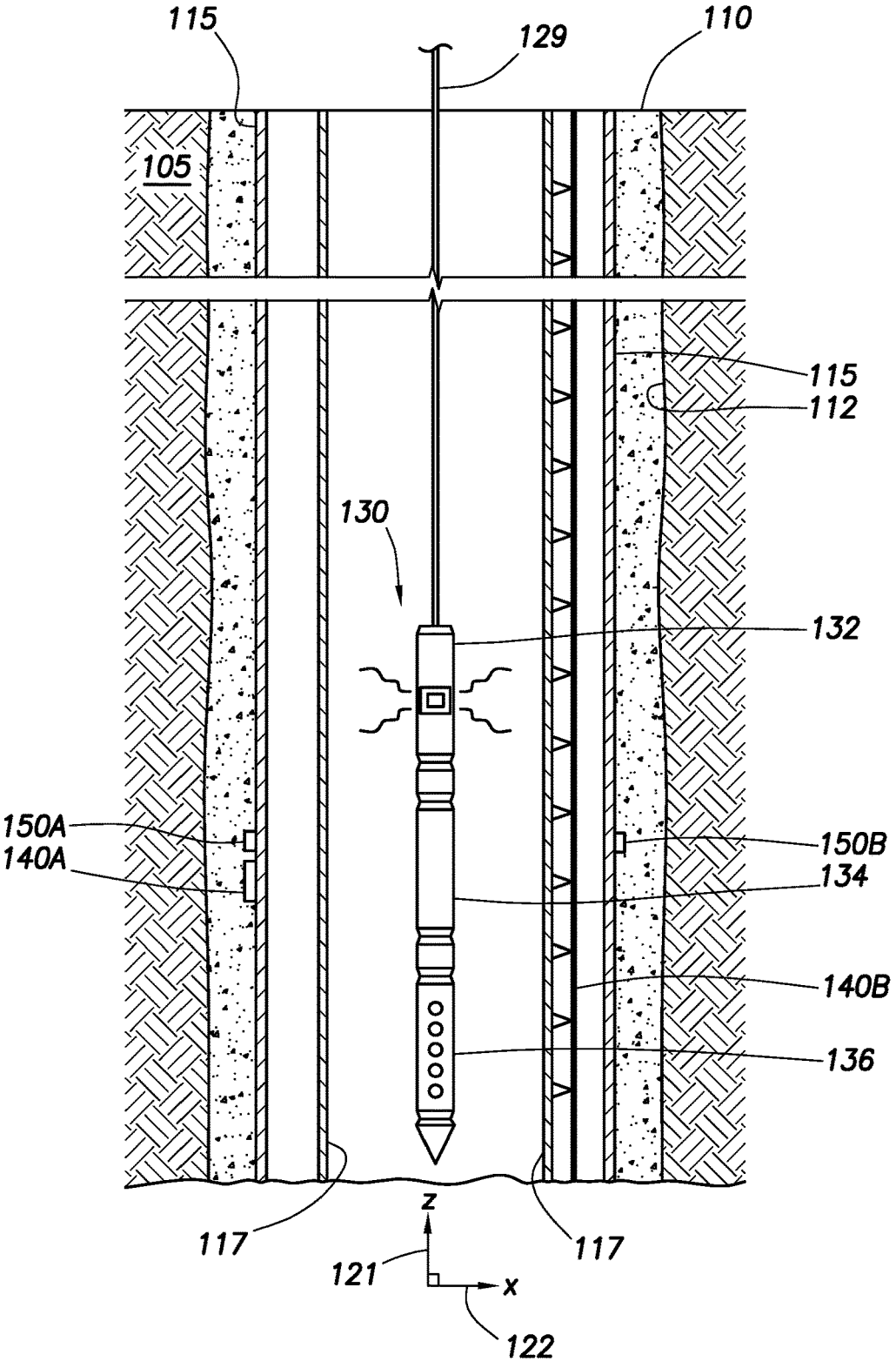
FIG. 1 illustrates an example of a radial orientation detection device disposed in a wellbore in a subterranean formation in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for depth and orientation detection tools. More particularly, but not by way of limitation, embodiments of the present invention include methods and systems using depth and radial orientation tools for certain downhole operations, including perforation of downhole conduits.

In certain embodiments, methods for determining the radial orientation of one or more downhole components comprise the steps of providing a substantially nonradioactive target mass, installing the target mass downhole, irradiating the substantially nonradioactive target mass to form a relatively short-lived radioactive target mass which may then be detected with a radiation detector. In this way, the target mass may act as a radial orientation marker, indicating the radial orientation of the target mass. Where the target mass is situated downhole in a known radial relationship to another downhole component, the radial orientation of the other downhole component may be deduced once the radial orientation of the target mass is determined.

Knowing the radial orientation of a particular downhole component may be useful in a variety of downhole operations, including, but not limited to perforation operations. For example, where it is desired to avoid damaging a sensitive downhole device such as a cable, it is useful to be able to determine the radial orientation of the sensitive apparatus to avoid damaging it during perforation operations. Other optional variations and enhancements are described further below.

Advantages of such depth or radial orientation detection methods and devices include, but are not limited to, higher accuracies, reduced health, safety, and environmental risks due to avoiding handling and logistics of radioactive materials above surface, and reduced complexity as compared to conventional methods.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1 illustrates a cross-sectional view a wellbore intersecting a subterranean formation. Casing 115 is cemented in borehole 112 through subterranean formation 105. Production tubing 117 is nested within casing 115.

After completion of the wellbore, one or more conduits need to be perforated to allow communication of formation fluids into production tubing 117 to allow hydrocarbons to be produced to surface 110. As shown here in FIG. 1, both production tubing 117 and casing 115 need to be perforated to allow formation fluids into production tubing 117. In some embodiments, however, production tubing terminates at some point above the interval to be produced. In these embodiments, only casing 115 would need to be perforated as the terminal open end of production tubing 117 would permit flow into production tubing 117 without perforating production tubing 117.

Perforation operations downhole must take into account the presence of any sensitive devices downhole in proximity to the conduits to avoid damaging the sensitive devices. The term "sensitive apparatus or device," as used herein, refers to any downhole component to which it is desired to avoid damage. Here, sensitive device 140A is attached to casing 115, and sensitive device 140B, in this case, a cable, is attached to production tubing 117 opposite to sensitive device 140B. It is recognized that the sensitive devices may be situated anywhere in the near wellbore region, including, but not limited to, being attached to casing 115 or production tubing 117.

For convenience of reference, the axis parallel to the conduits is referred to herein as a "longitudinal axis." The term "radial axis," as used herein, refers to the axis normal to the longitudinal axis and normal to the surface of the conduits. Stated another way, the radial axis is parallel to any plane that is normal to the longitudinal axis. Recognizing that over long distances, the direction of the conduits may change as a function of depth in subterranean formation 105, the terms longitudinal axis and radial axis refer to the orientation of the axis local to the region of interest. In FIG. 1, the longitudinal axis is labeled the "z" axis, whereas the radial axis is labeled the "x" axis.

Before perforating either conduit (e.g. casing 115 or production tubing 117), it is desired to determine the radial orientation of sensitive device 140A or 140B to avoid damaging either device 140A or 140B. Radial orientation detection device 130 is run down through borehole 112 to determine the radial orientation of one or more downhole components, in this case, sensitive device 140A, sensitive device 140B, or both. Radial orientation detection device 130 works in conjunction with one or more target masses, in this case, target mass 150A, target mass 150B, or both. As will be explained in more detail, radial orientation detection device 130 is adapted to determine the radial orientation of a target mass. Since the spatial relationship between the target mass and its corresponding sensitive apparatus is known, the radial orientation of the sensitive apparatus can be determined once the radial orientation of the target mass is determined. In this way, by determining the radial orientation of one of the target masses, the radial orientation of any corresponding sensitive apparatus may be deduced.

In some configurations, a target mass may be situated directly adjacent to a sensitive device. As shown in FIG. 1, target mass 150A is situated directly adjacent to sensitive device 140A. Target mass 150B is situated in the same radial orientation as sensitive device 140B. In certain embodiments, the target mass may be integral to the sensitive device. In some embodiments, it may be preferred to clamp the target mass to the sensitive device. It is also recognized that a target mass may be located in any spatial relationship to its corresponding sensitive device by any radial offset angle.

Figure 2:
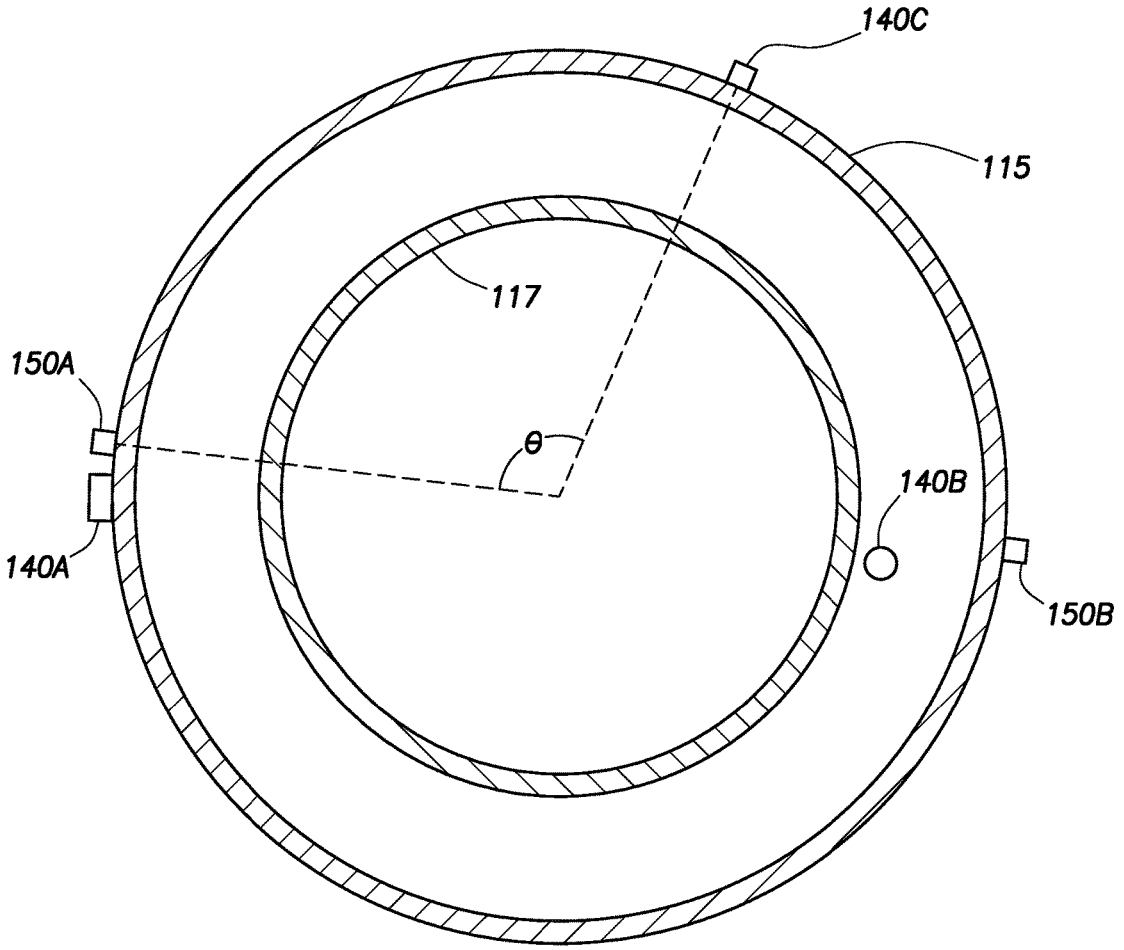
FIG. 2 illustrates a cross-sectional aerial view of a wellbore with several target masses and sensitive devices disposed thereon in accordance with one embodiment of the present invention.

FIG. 2 shows an aerial cross-section view, illustrating these concepts. Production tubing 117 is nested within casing 115. Sensitive devices 140A and 140C are attached to casing 115, and sensitive device 140B is attached to production tubing 117. Target masses 150A and 150B are also attached to casing 115. The term, "radial offset angle," as used herein, refers to the radial angle between a target mass and its corresponding sensitive device. By knowing the radial offset angle between a target mass and a sensitive device, the radial orientation of the sensitive device may be deduced once the radial orientation of the corresponding target mass is determined. As an example of a target mass offset from a sensitive device, target mass 150A is situated at a radial offset angle ($\Theta$) of about 110° from sensitive device 140C. Target mass 150A is situated at a radial offset angle of about 180° from sensitive device 140B, whereas target mass 150B is situated at a radial offset angle of about 180° from sensitive device 140A. It is recognized that a target mass may be situated at any radial spatial relationship relative to its corresponding sensitive device, that is, any angle between 0° and 360°.

Although the example depicted in FIG. 2 contemplates three target masses, it is recognized that any number of target masses may be used, including simply using a single target mass to locate one or more sensitive devices.

Upon determining the position of the target mass together with knowledge of the spatial relationship between the target mass and its corresponding sensitive device, a perforation target may be determined. The perforation target refers to any radial orientation away from the sensitive device that, when perforated, avoids damage to the sensitive device. The perforation target may be a single radial orientation or a range of safe perforation angles, as desired. Often, a perforation target will be chosen that is situated about 180° from the sensitive device to minimize damage to the sensitive device. Examples of suitable perforation targets include, but are not limited to, angles of about 170° to about 190° from the sensitive device. In certain embodiments, the target mass is located at the preferred perforation target or in the same radial orientation as the preferred perforation target.

Radial orientation detection device 130 may use a number of mechanisms to determine the radial orientation of a target mass. In certain embodiments, radial orientation detection device 130 comprises irradiation module 132 and radiation detection module 134. Initially, target masses 150A and 150B are substantially nonradioactive so as to not pose a safety, health, or environmental threat when being handled above surface. The initial nonradioactivity of target masses 140A and 140B significantly eases the permitting, logistics, and handling of target masses 140A and 140B.

When the target masses are established downhole, safely away from the surface and personnel, irradiation module may expose the region in proximity to the target masses to convert the substantially nonradioactive target masses into temporarily radioactive target masses.

Irradiation module 132 may use any type of radiation sufficient to convert substantially nonradioactive target masses into temporarily radioactive target masses. Examples of suitable ionizing radiation include, but are not limited to, gamma radiation, neutron radiation, proton radiation, UV radiation, X-ray radiation, or any combination thereof. Examples of suitable ionizing radiation modules include, but are not limited to, a high flux neutron generator source (e.g. acceleration of deuterium onto a tritium target source), a chemical neutron source, a high energy X-ray tub, chemical gamma ray sources (e.g. cesium, cobalt 60, etc), or any combination thereof. Examples of suitable high-flux neutron sources include, but are not limited to, plutonium-beryllium, americium-beryllium, americium-lithium, an accelerator-based neutron generator, or any combination thereof. As used herein, the term "high-flux neutron source," refers to any neutron generator or chemical neutron source, generally producing about 10,000 or more neutrons per second (e.g. present commercial minitrons for logging produce approximately 4*10^8 neutrons per second). In response to the desire to move away from chemical source neutron tools, some modern neutron tools have been equipped with electronic neutron sources, or neutron generators (e.g. minitrons). Neutron generators contain compact linear accelerators and produce neutrons by fusing hydrogen isotopes together. The fusion occurs in these devices by accelerating either deuterium ($^2$H=D) or tritium ($^3$H=T), or a mixture of these two isotopes, into a metal hydride target, which also contains either deuterium ($^2$H) or tritium ($^3$H), or a mixture of these two isotopes. In about 50% of the cases, fusion of deuterium nuclei (d+D) results in the formation of a $^3$He ion and a neutron with a kinetic energy of approximately 2.4 MeV. Fusion of a deuterium and a tritium atom (d+T) results in the formation of a $^4$He ion and a neutron with a kinetic energy of approximately 14.1 MeV.

The target mass may comprise any material that, when exposed to ionizing radiation, becomes radioactive for a relatively short half life. Examples of suitable materials include, but are not limited to, materials, which when exposed to ionizing radiation, produce radioactive materials having relatively short half-lives of less than about 32 days, less than about 8 days, less than about 3 days, less than about 30 seconds, or less than about 1 second. One advantage of using target masses with relatively short half-lives is that the target masses remain radioactive for only a relatively short period of time, reducing possible radiation exposure risks. Thus, if the target mass needs to be removed from the well bore and handled above surface for example, any health and safety exposure issues can be avoided. Examples of suitable materials for target masses include, but are not limited to, tin, molybdenum, gallium, scandium, chlorine, rhodium, cadmium, cesium, tellurium, iodine, xenon, gold, water, oxygen, or any combination thereof. Additionally, salts or compounds of any of the foregoing materials may be used as desired.

Upon forming a temporarily radioactive target mass, the radioactive target mass may then be detected. In this example, radiation detection module 134 detects and determines the radial orientation of now radioactive target mass 150A or 150B. Radiation detection module 134 may comprise any detection device capable of detecting radioactive responses from a radioactive target mass, including, but not limited to, an x-ray detector, a gamma ray detector, a neutron detector, and a proportional detector (e.g. proportional to the energy of the particle detected). These detectors may comprise various components shielded to measure in certain radial directions, or shielded with an open window and rotated about the axis of the logging tool. In either case, a reference to radial angle versus a reference must be known. In the case of the use of multi-detectors, the tools geometry is known to a reference within the tool. In the case of rotating a single windowed detector, the radial direction of the detector window is recorded and known at all times. A sync or reference may be included to indicate orientation as the device rotates. This reference may include reference to a gravity vector, or based on rotation (such as generating a pulse or pulses each time the tool rotates past a known position on the non-rotating portion of the tool. In certain embodiments, radiation detection module 134 comprises an x-ray backscatter spectrometer.

Upon determining the radial orientation of one of the radioactive target masses (e.g. 150A), the radial orientation of one of the sensitive devices (e.g. 140A or 140B) may be deduced since the radial offset angles between the radioactive target mass 150A and the sensitive devices 140A and 140B are known. Here, for example, the radial offset angle between 150A and 140A is about 10°, whereas the radial offset angle between 150A and 140B is about 180°. In this way, the radial orientation of either sensitive device 140A or 140B may be determined.

Upon knowing the location of one or more sensitive devices, a perforation target may be selected in a direction oriented substantially away from the sensitive devices. In certain embodiments, the perforation target is an angle or zone of angles about 180° from the sensitive device or from about 170° to about 190° from the sensitive device. In certain embodiments, the perforation target is chosen as any radial orientation that avoids or minimizes substantial risk of damage to the sensitive device.

Although irradiation module 132, radiation detection module 134, and perforation gun 136 are shown in FIG. 1 as combined into one integral device, it is recognized that one or more of these modules may be formed into separate, stand-alone devices and may be configured in any order to make an assembly.

In certain embodiments, a target mass may comprises a material that is substantially radioactively inert. Examples of suitable target mass materials include, but are not limited to, boron, boronated compounds, gadolinium, cadmium, salts of any of the foregoing, or any combination thereof. Where the target mass is selected from a material that is substantially radioactively inert, such as boron, radiation detection module 134 may detect the target mass as any area or region of reduced radioactive response. Normally, most materials become radioactive upon neutron irradiation or bombardment. Boron and boronated compounds, on the other hand, are unusual compared to most other materials in that they are substantially radioactively inert. Thus, in the case of boron and most boronated compounds, what is detected by logging tools is a high neutron absorption the usually produced higher gamma ray counts. Typically, return gamma counts decrease substantially, rather than increasing as is more normal with most elements. The boron absorbs the neutrons and emits alpha particles to release energy and stabilize the nuclide. Because alpha particles only travel micro-meters in the formation, they are not detected by logging tools.

In this way, substantially non-radioactive target masses may be located and their radial orientation determined. Accordingly, the radial orientation of any sensitive devices with known spatial relationships to the target mass may then be deduced. Again, by using substantially radioactively inert target masses, the safety, health, and environmental exposure risks associated with radioactive target masses may be avoided.

In certain embodiments, the target mass may comprise an electromagnet. In certain embodiments, the electromagnet may comprise a solenoid having a ferromagnetic core. The target mass may be left in its inactivated state until it is desired to locate the target mass. In one example, once detection of the target mass is desired, the electromagnet may be activated. Upon activation, a radial orientation detection module may detect the presence and radial orientation of the target mass by the magnetic field resulting from the electromagnet activation. Where the target mass is an electromagnet, the radial orientation detection module may comprise a device such as the Baker Vertilog or other magnetic flux measurement devices.

The electromagnet may be battery powered, powered from a power cable from the surface, induction powered, or any combination thereof. In this way, problems that would normally occur with using permanent magnets, such as the undesired accumulation of metallic debris around the magnet, are avoided. The undesirable attraction of debris that would naturally accumulate around magnets, could impede production flow or cause interference with logging measurements.

In certain embodiments, the target mass comprises a magneto-disruptive element. The term, "magneto-disruptive element," as used herein, refers to any element that produces a recognizable or distinguishable magnetic flux signature. Examples of suitable magneto-disruptive elements include, but are not limited to, certain non-uniformities in metal elements such as gouges, scratches, and other non-uniform flaws. A magneto-disruptive element has a distinguishable magnetic flux signature when its magnetic flux signature is distinguishable from the background magnetic flux responses of the components in proximity to the target mass.

Where magneto-disruptive elements are used as the target mass, the radial orientation detection device may comprise a magnetic flux leakage tool, such as the Schlumberger PAL, the EM Pipe Scanner, or the Baker Vertilog, or any combination thereof.

Figure 3:
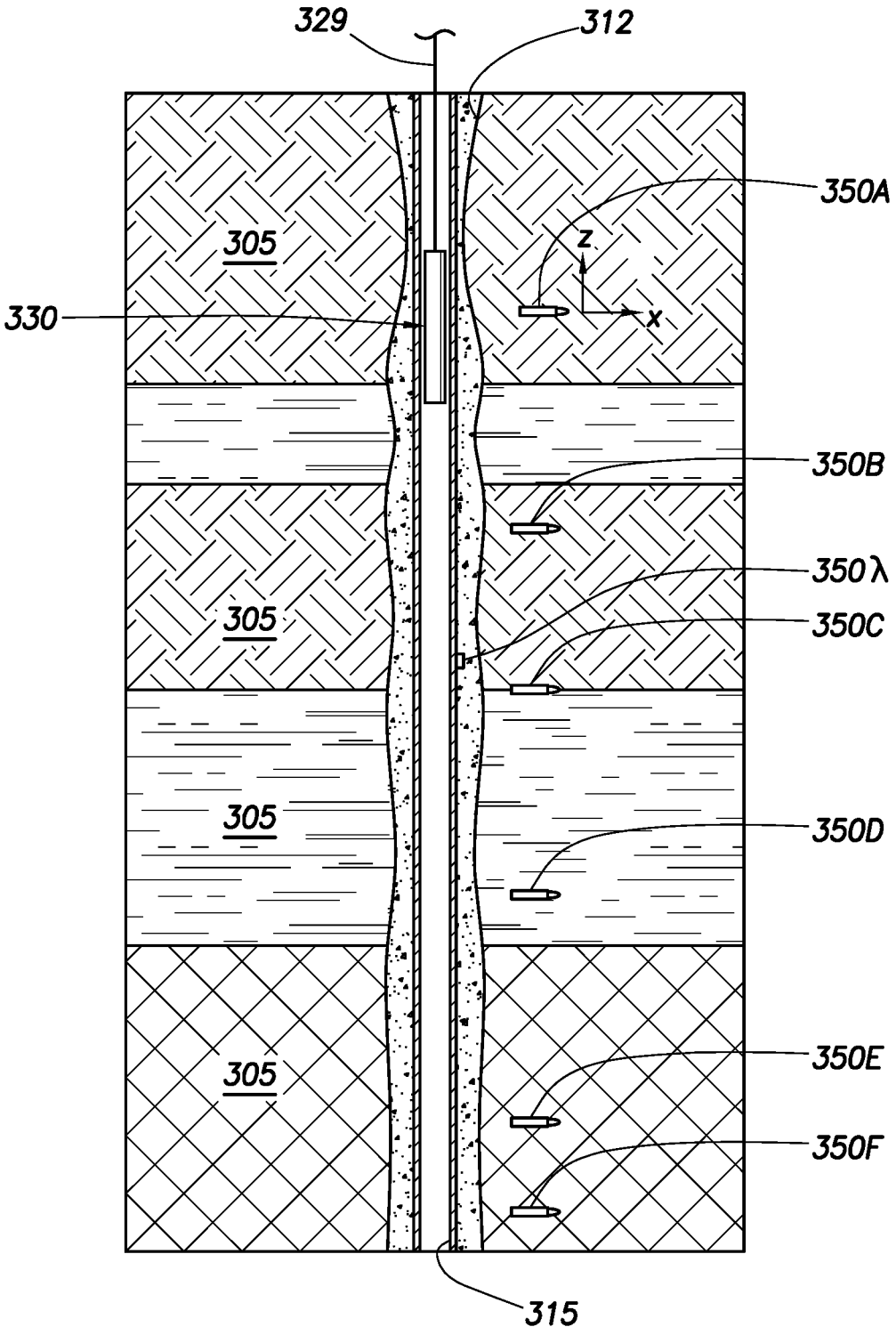
FIG. 3 illustrates a cross-sectional view of a detection device disposed in a wellbore in a subterranean formation for measuring depth and/or formation deformation in accordance with one embodiment of the present invention.

In addition to using target masses to detect the radial orientation of one or more target masses, target masses may be used as a depth measuring device. FIG. 3 shows a cross-sectional view illustrating this concept. Casing 315 is completed in wellbore 312, which intersects subterranean formation 305. Target mass 150λ has been preinstalled on or in proximity to casing 315 at a depth that is desired to be measured at some later time. Where it is desired to measure the depth of target mass 150λ, the target masses may comprise any of the previously-described types of target masses, including, but not limited to, non-radioactive target masses, short-lived radioactive target masses, substantially radioactively inert target masses, electromagnet target masses, magneto-disruptive element target masses, or any combination thereof. Detection device 330 may run along casing 315 using wireline 329 to detect the depth of target mass 350λ. Detection device 330 may comprise a detection module that corresponds to any of the various types of target masses described herein including, but not limited to, x-ray detectors, gamma ray detectors, neutron detectors, magnetic flux detectors, or any combination thereof. In this way, detection device 330 detects the depth of target mass 330.

The depth measuring concept may be extended to measure deformation of a subterranean formation. FIG. 3 also illustrates this concept. By situating a plurality of target masses at a series of depths throughout a subterranean formation (e.g. 350A, 350B, 350C, 350D, 350E, and 350F), one may establish an initial baseline reference depth of each target mass. At a later date, when desired, subsequent locations of each target mass may be determined. By comparing the initial baseline reference depths of the target masses to the subsequent locations of the target masses, a deformation (e.g. a compression or subsidence) of the formation may be determined.

It is recognized that any of the various types of target masses (e.g. short-lived radioactive target masses, substantially radioactively inert target masses, electromagnet target masses, magneto-disruptive element target masses, or any combination thereof) and their corresponding detection module devices may be used with any of the methods described herein (e.g. radial orientation determination, depth determination, and formation deformation detection, etc).

It is recognized that any of the elements and features of each of the devices described herein are capable of use with any of the other devices described herein without limitation. Furthermore, it is recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention. Also, the terms in the claims have their plain, ordinary meaning unless otherwise explicitly and clearly defined by the patentee.

The invention claimed is:

1. A method for perforating a cemented casing in a wellbore, comprising the steps of:

providing a target mass that is substantially radioactively inert into a casing cemented into a wellbore, disposed in a subterranean formation, wherein the casing is characterized by a longitudinal axis and a radial axis;

locating the target mass in proximity to the casing, wherein the target mass is situated at a known radial offset angle from a sensitive apparatus in said casing;

irradiating a region around the target mass in said casing;

detecting the radial location of the target mass in said casing as an area of reduced radioactive response;

determining a perforation target in said casing based on the radial location of the target mass and the known radial offset angle so as to reduce the risk of damage to the sensitive apparatus; and perforating the casing at the perforation target in a direction substantially away from the sensitive apparatus so as to not damage the sensitive apparatus.

2. The method of claim 1, wherein the target mass comprises boron.

3. The method of claim 1, wherein the target mass is a boronated compound, a salt thereof, or any combination thereof.

4. The method of claim 1, wherein the target mass is boron, a boronated compound, gadolinium, cadmium, salts of any of the foregoing, or any combination thereof.

5. The method of claim 1, wherein the target mass is situated directly adjacent to the sensitive apparatus.

6. The method of claim 1, wherein the sensitive apparatus is a cable.

7. The method of claim 1, further comprising the step of attaching the sensitive apparatus to the casing and wherein the step of locating the target mass further comprises clamping the target mass to the sensitive apparatus.

8. The method of claim 1, wherein the step of detecting the radial location of the target mass further comprises the step of detecting the radial location of the target mass using a gamma ray detector.

9. The method of claim 1, wherein the radial offset angle is about 0° or about 180°.

10. The method of claim 9, wherein the perforation target is radially situated about 170° to about 190° from the sensitive apparatus.

11. The method of claim 1, wherein the perforation target is radially situated about 180° from the sensitive apparatus.

12. The method of claim 1, wherein a production tubing is inside said casing and said target mass is provided into said production tubing and both said production tubing and said casing are perforated.

13. A method for perforating a wellbore, comprising the steps of:

i) deploying a target mass that is substantially radioactively inert into a production tubing inside a casing cemented into a wellbore disposed in a subterranean formation, wherein said tubing is characterized by a longitudinal axis and a radial axis;

ii) locating said target mass in proximity to said tubing wherein said target mass is situated at a known radial offset angle from a sensitive apparatus in said tubing or in said casing;

iii) irradiating a region around said target mass;

iv) detecting a radial location of said target mass in said tubing as an area of reduced radioactive response;

v) determining a perforation target in said tubing and said casing based on said radial location of said target mass and said known radial offset angle so as to reduce the risk of damage to said sensitive apparatus; and vi) perforating said tubing and said casing at said perforation target in a direction substantially away from said sensitive apparatus so as to not damage said sensitive apparatus.

* * * * *